United States Patent [19]

Krappel et al.

[11] Patent Number: 5,038,745

[45] Date of Patent: Aug. 13, 1991

[54] IGNITION UNIT FOR INTERNAL COMBUSTION ENGINES

[75] Inventors: Alfred Krappel, Ismaning; Johannes Guggenmos, Fürstenfeldbruck; Josef Holzmann, Munich; Georg Buchholz; Robert Tschuk, both of Aschaffenburg, all of Fed. Rep. of Germany

[73] Assignee: Bayerische Motoren Werke AG, Fed. Rep. of Germany

[21] Appl. No.: 608,624

[22] Filed: Nov. 6, 1990

Related U.S. Application Data

[63] Continuation of Ser. No. 233,362, Aug. 18, 1988, abandoned.

[30] Foreign Application Priority Data

Aug. 18, 1987 [DE] Fed. Rep. of Germany ..... 3727458

[51] Int. Cl.[5] ..... F02P 3/00

[52] U.S. Cl. ..... 123/635; 123/634

[58] Field of Search ..... 123/634, 635, 643, 169 PA, 123/169 PH

[56] References Cited

U.S. PATENT DOCUMENTS

| | | | |
|---|---|---|---|
| 1,501,484 | 7/1924 | Hunt | 123/634 |
| 4,099,510 | 7/1978 | Perrier et al. | 123/634 |
| 4,248,201 | 2/1981 | Tsutsui et al. | 123/634 |
| 4,446,842 | 5/1984 | Iwasaki | 123/635 |
| 4,514,712 | 4/1985 | McDougal | 123/169 PA |
| 4,516,558 | 5/1985 | Oohashi | 123/634 |
| 4,617,907 | 10/1986 | Johansson et al. | 123/635 |
| 4,671,248 | 6/1987 | Gillbrand et al. | 123/635 |
| 4,831,995 | 5/1989 | Biton | 123/635 |

FOREIGN PATENT DOCUMENTS

| | | |
|---|---|---|
| 3620826 | 1/1987 | Fed. Rep. of Germany . |
| 641710 | 8/1950 | United Kingdom . |

OTHER PUBLICATIONS

Catalog 4, Beru, Apr. 1977, pp. 1-11.

"MTZ, Motortechnische Zeitschrift", 46 (1985) 4, pp. 134, 135.

*Primary Examiner*—Andrew M. Dolinar

*Assistant Examiner*—M. Macy

*Attorney, Agent, or Firm*—Evenson, Wands, Edwards, Lenahan & McKeown

[57] ABSTRACT

An ignition unit for internal combustion engines with an ignition coil having a ferromagnetic core integrated with a spark plug connector, about the main core of which is arranged a primary winding and a secondary winding surrounded by an insulating body; the ignition coil and the spark plug connector are so arranged to one another that the axial directions of the spark plug connector and of the main core of the ignition coil form at least approximately a right angle.

32 Claims, 4 Drawing Sheets

IGNITION UNIT FOR INTERNAL COMBUSTION ENGINES

This is a continuation of application Ser. No. 07/233,362, filed Aug. 18, 1988, now abandoned.

BACKGROUND AND SUMMARY OF THE INVENTION

The present invention relates to an ignition unit for internal combustion engines with an ignition coil having a ferromagnetic core integrated into a spark plug connector, about whose main core is arranged a primary and secondary winding surrounded by an insulating body.

Such an ignition unit is already known from the DE-OS 37 20 826. In this prior art ignition unit, the ignition coil integrated with the spark plug connector essentially consists of a rod-shaped ferromagnetic core, of an inner cover cylinder made of an insulating material and surrounding the core, on the outer circumference of which is mounted the secondary winding, and of an external cover cylinder also consisting of insulating material and surrounding the secondary winding with a radial spacing, which carries the primary winding along its outer circumference. The interstices between the rod-shaped core, the inner cover cylinder and the outer cover cylinder are thereby filled with an electrically insulating filler or sealing compound. This ignition coil is so mounted on the associated spark plug connector that the axial directions of the elongated rod-shaped core and of the spark plug connector coincide. For integrating the spark plug connector with the rod-shaped ignition coil, the entire ignition unit is embedded in a casing or cover body made of an elastic insulating material.

The disadvantage of this already known ignition unit consists in particular in that it requires a very large installation space in the axial direction of the spark plug connector which can be traced back to the alignment of the ignition coil longitudinal axis in the axial direction of the spark plug connector. By reason of its large space requirement in the axial direction of the spark plug connector the known ignition unit is only inadequately suited for the installation in modern motor vehicle internal combustion engines because as low a structural height as possible is aimed at in these modern motor vehicle internal combustion engines by reason of the ever-decreasing space availability in the engine space of modern automobiles.

It is therefore the object of the present invention to provide an ignition unit of the aforementioned type consisting of a spark plug connector and of an ignition coil which, combined with best functioning, insulation safety, temperature resistance and vibration strength, is characterized by a small space requirement in the axial direction of the spark plug connector.

The underlying problems are solved according to the present invention in that the ignition coil and the spark plug connector are so arranged to one another that the axial directions of the spark plug connector and of the main core of the ignition coil form at least approximately a right angle.

It is achieved by this constructive arrangement of the ignition coil on the associated spark plug connector that the ignition unit has a minimum structural height in the axial direction of the spark plug connector. Owing to the arrangement of the ignition coil transversely to the axial direction of the spark plug connector, it becomes possible to accommodate the ignition unit consisting of the spark plug connector and of the ignition coil in the space which is available in customary cylinder heads of internal combustion engines for automobiles between the spark plug and the engine hood of the automobile and which up to now only served for the accommodation of the spark plug connector. An individual ignition coil-ignition system can be realized in this manner in which an ignition coil is directly coordinated to each individual spark plug. Such an individual ignition coil-ignition system offers the advantage that no open spark gaps exist and therebeyond, no high voltage ignition lines are required which, on the one hand, act as antennae and, on the other, can be easily damaged by animals, for example, Martens. An extraordinarily interference-free and functionally reliable ignition system can therefore be realized by the use of ignition systems according to the present invention.

According to a further feature of the present invention, the end areas of the main core carrying the primary and secondary winding are connected with each other by way of at least one core part disposed outside of the primary and secondary winding. Owing to this magnetic connection of the end areas of the main core, the magnetic stray or leakage field is minimized which leads to a considerable improvement of the efficiency.

Such a closed coil core is advantageously composed of two E-shaped halves whose center E-legs form together the main core. With this construction of the coil core the two center E-legs of the two E-shaped coil core halves can be introduced in a simple manner into the opening of the primary coil.

In order to achieve a uniform spark plug erosion, it is necessary that all ignition coils used in an individual coil ignition system have, to the greatest possible extent, the same inductance. The latter is determined decisively by a defined air gap in the coil core. With the use of a coil core of two E-shaped halves, this gap is provided preferably between the two center E-legs forming the main core. Owing to the arrangement of the air gap in the interior of the primary coil an undesired magnetic stray or leakage field can be avoided.

In order that the two E-shaped halves of the coil core cannot fall apart and in order that no stray or leakage field significantly impairing the efficiency of the ignition coil additionally occurs at the places, where the two E-shaped halves abut at one another, the outer legs of the two E-shaped halves are rigidly connected with each other.

It has thereby proven as particularly advantageous if the outer legs of the two E-shaped halves are welded together. An undesired air gap between the two coil core halves can be completely avoided by welding together the outer legs of the E-shaped halves of the coil core. A magnetic stray or leakage field which customarily occurs at such connecting places can thereby be nearly completely avoided in this manner, as a result of which an optimum efficiency of the ignition coil is assured. The air gap-free connection of the two coil core halves additionally offers the advantage that the ignition coil can be manufactured with only a small manufacturing tolerance as regards its inductance. The welding-together of the two coil core halves also offers the advantage compared to a threaded or riveted connection that no displacement of the magnetic flux takes place at the connecting places.

For purposes of a simple fastening of the entire ignition unit consisting of the spark plug connector and of the ignition coil at the cylinder head of an internal combustion engine, one bore each for receiving a fastening bolt is provided in the attachment areas of the outer legs of the two E-shaped halves of the coil core.

In order to maintain the cross section of the coil core within the area of the bores provided for the accommodation of fastening bolts, the attachment areas of the outer legs of the two E-shaped halves of the coil core are constructed reinforced, whereby the bores are arranged at least partly in the reinforced areas.

According to a preferred further feature of the present invention, the winding wires of the primary winding and/or of the secondary winding are wound in layers, whereby one insulating paper layer each is provided between the individual winding layers. As with this winding technique, the individual winding layers are additionally insulated with respect to one another by an insulating paper layer, in addition to the wire insulation, a very good insulation safety and dielectric strength is achieved.

The insulation safety of the ignition coil can be additionally optimized in that the winding wire sections of a winding layer are each arranged with a spacing to one another and the free spaces between the winding wire sections are filled out with a cast insulating material or filler compound.

Preferably the spacing of the winding wire sections amounts to about 5 to 10% of the respective winding wire diameter. This spacing of the winding wire sections represents an optimum as regards the two concurring goals; namely, to make the ignition coil as compact as possible, on the one hand, and to construct the same as safe with respect to insulation as possible, on the other.

According to a further feature of the present invention, the insulating body surrounding the primary and secondary winding consists completely of a cast material whereby it is cast in one piece without the use of a separate casing. On the one hand, such an insulating body can be manufactured cost-favorably (as no separate casing is required to be filled with the cast material) and, on the other, offers technical advantages compared to the known insulating body. Thus, in the insulating body according to the present invention, in contrast to the known insulating body, no differing thermal expansions can occur because it is made homogeneously of the same material. It therefore also does not possess any separating layer which with the known insulating body between the casing and the adjoining cast mass can lead to glow discharges.

In order to prevent a spark erosion between the coil core and the insulating body, the outer shape of the insulating body is so constructed that with the use of a coil core composed of two E-shaped halves the insulating body abuts far-reachingly at the inner circumference thereof.

By constructing the insulating body in the shape of a handle it is achieved that the entire ignition unit consisting of spark plug connector and ignition coil with coil core can be manually handled and gripped safely, especially in the installation at, respectively, disassembly from the cylinder head of an internal combustion engine.

According to a preferred further feature of the present invention, the primary connecting contacts connected with the primary coil are led out of the insulating body in the axial direction of the primary coil. This arrangement of the primary connecting contacts, by contrast to the arrangement of the primary connecting contacts of the primary coil in the axial direction of the spark plug connector, does not lead to an undesired increase of the structural height of the ignition unit in the axial direction of the spark plug connector.

Advantageously, the primary connecting contacts are thereby arranged in a plug-like extension of the insulating body. Preferably detents for lockingly engaging a corresponding plug extending over the plug-like extension are provided at the extension of the insulating body. A safe plug connection is achieved by the detent connection of the corresponding plug extending over the plug-shaped extension.

According to a preferred further development of the present invention, a contact element electrically connected with the secondary winding is provided at the end of the insulating body facing the spark plug connector, by means of which a safe contact with the spark plug connector is established.

For compensating a possible axial displacement between the axis of the spark plug and therewith also of the emplaced spark plug connector and of the axis of the ignition coil threadably fastened at the cylinder head of the combustion engine, a joint-like movable, electrically conducting connection is provided between the contact element and the electrically conducting part of the spark plug connector. Preferably, this joint-like movable, electrically conducting connection is formed by a spring element which can be manufactured in a cost-favorable manner.

In order to be able to additionally compensate for the tolerances and vibrational movements between the spark plug and the ignition unit consisting of the spark plug connector and of the ignition coil fastened at the cylinder head of the combustion engine, which occur in the axial direction of the spark plug, a coil spring conically enlarged up to its free end is provided as contact part of the spark plug connector acting on the center electrode of the respective spark plug. Owing to the conical construction of the coil spring, in addition to a good contact by reason of the large abutment area at the also conical spark plug center electrode, also a simple mounting of the ignition unit on the spark plug is assured.

In order to prevent a penetration of moisture into the contact area between the spark plug center electrode and the contact part of the spark plug connector, according to a still further feature of the present invention, a casing is provided as part of the spark plug connector which protrudes beyond the contact part of the spark plug connector and forms a socket that completely covers the (porcelain) spark plug neck and circumferentially abuts securely at the threaded head of the spark plug.

In order to attain, on the one hand, a good press fit of the socket end on the threaded head of the spark plug and, on the other, an easy threading of the spark plug neck into the socket, the inner diameter of the socket increases towards the outside within the area of its free end. As the socket end must circumferentially securely abut with a press fit at the threaded head of the spark plug, it is necessary that the casing of the spark plug connector be flexible. It is therefore made advantageously of an elastic silicon rubber.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 3:
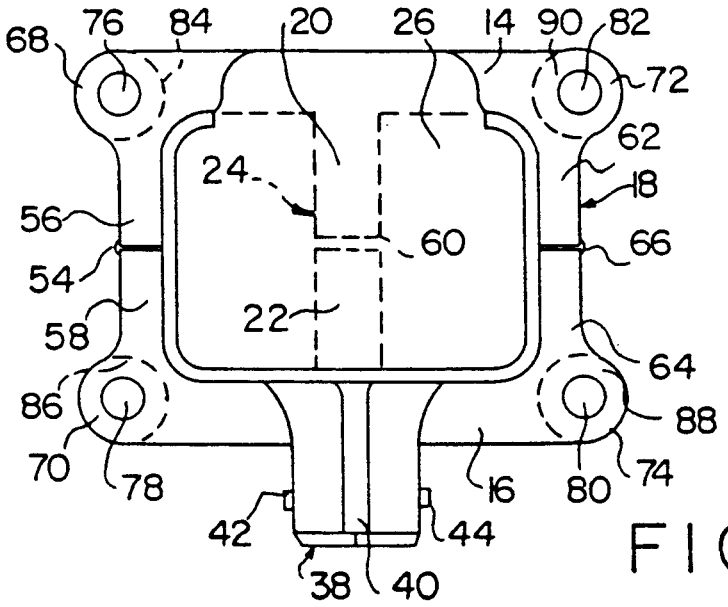
FIG. 3 is a plan view on the ignition unit illustrated in FIGS. 1 and 2 in which the parts of the coil core that are not visible are indicated in dash lines.
Figure 4:
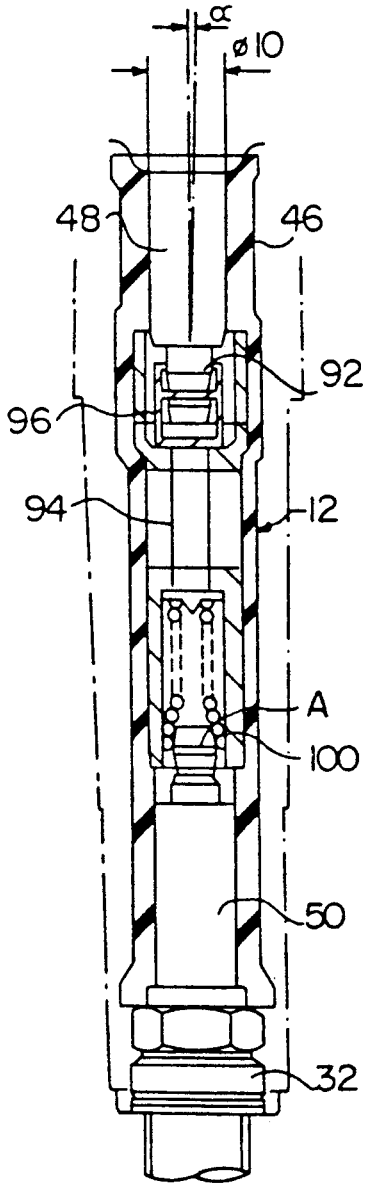
FIG. 4 is a cross-sectional view through the spark plug connector of the ignition unit illustrated in FIGS. 1 to 3.

Referring now to the drawing wherein like reference numerals are used throughout the various views to designate like parts, the ignition unit illustrated in the drawing essentially consists of an ignition coil generally designated by reference numeral 10 and of a spark plug connector generally designated by reference numeral 12 which is directly attached at the ignition coil 10. The ignition coil 10 includes a coil core 18 assembled of two E-shaped halves 14 and 16, whose center E-legs 20 and 22 form the main core generally designated by reference numeral 24 (see in particular also FIG. 3). The primary and secondary winding X, shown in FIGS. 6A and 6B, of the ignition coil 10 is concentrically arranged about this main core 24 extending transversely to the axial direction of the spark plug connector 12. The primary and secondary winding X of the ignition coil 10 is cast-in within an insulating body 26 which consists completely of a homogeneous casting mass and is cast in one piece without the use of a casing body as mold. Near its upper end, the insulating body 26 includes on both sides a recess 28, respectively, 30 which make it possible that the entire ignition unit can be mounted in a simple manner on a spark plug 32 and also be pulled off again from the spark plug. For purposes of contact of the ignition coil 10 at the primary side, the primary connecting contacts 34 and 36 electrically connected with the primary coil are led out of the insulating body 26 in the axial direction of the primary coil and therewith of the main core 24 above the coil core 18. The primary connecting contacts 34 and 36 are thereby arranged in a plug-shaped extension 38 cast integral with the insulating body 26. The extension 38 has a nearly rectangular cross section and includes on its top side a guide groove 40 for the corresponding plug, not shown in the figures. In order to be able to reliably and lockingly connect such a corresponding plug, extending over the plug-shaped extension 38, at the plug-shaped extension 38 of the insulating body 26, detents 42 and 44 are provided at the two lateral outer surfaces of the plug-shaped extension 38 (FIG. 3). As can be seen further from FIG. 1, the lower part of the insulating body 26 facing the spark plug connector 12 is constructed essentially semi-circularly shaped as viewed from in front. A connecting member 48 inserted into the upper part of the casing 46 of the spark plug connector 12 is cast integral with the end of the insulating body 26 facing the spark plug connector 12 (FIG. 4). As can be further seen from FIG. 1, the casing 46 of the spark plug connector 12 forms within the area of the spark plug 32 a socket which completely covers the spark plug neck 50 and securely abuts circumferentially at the threaded head 52 thereof. The internal construction of the spark plug connector 12 as well as the jointed connection thereof with the ignition coil 10 will be described by reference to FIGS. 4 and 5.

Figure 1:
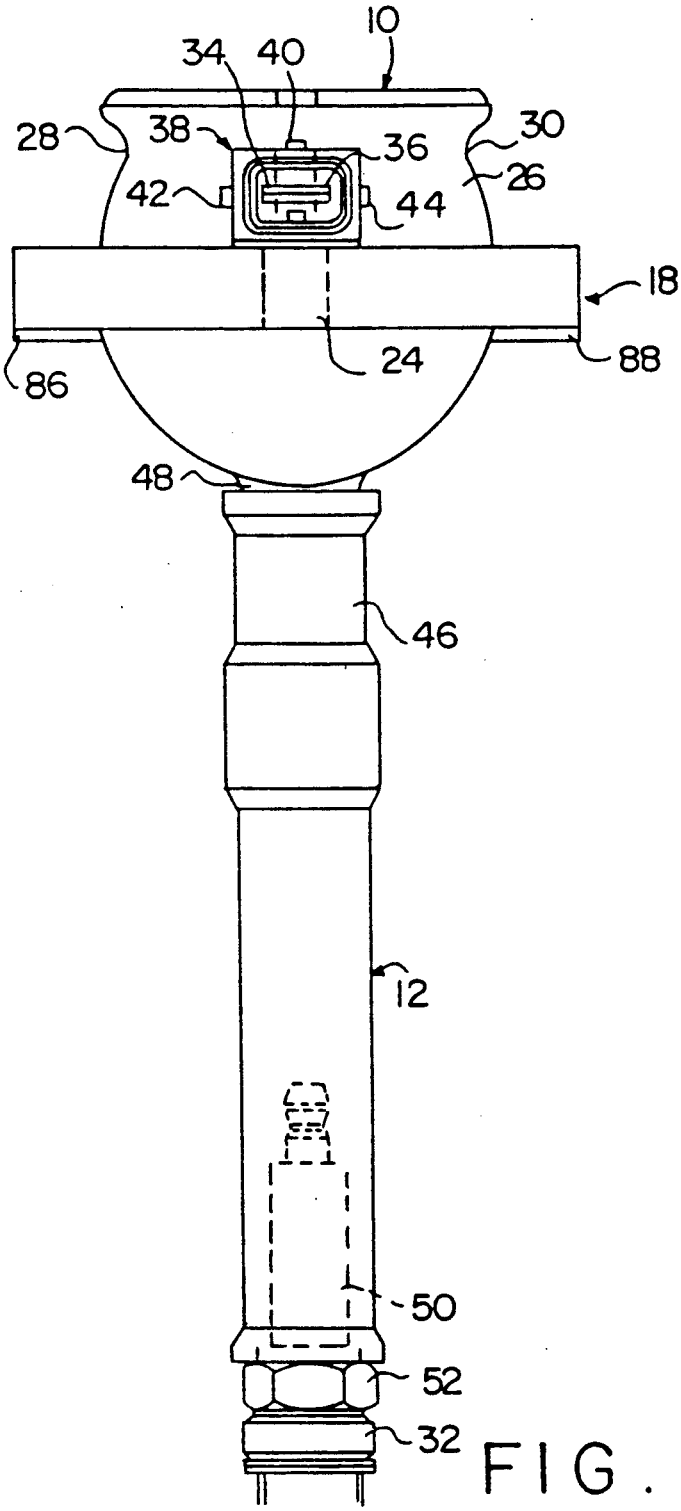
FIG. 1 is a front elevational view of an ignition unit according to the present invention, mounted on a spark plug.
Figure 2:
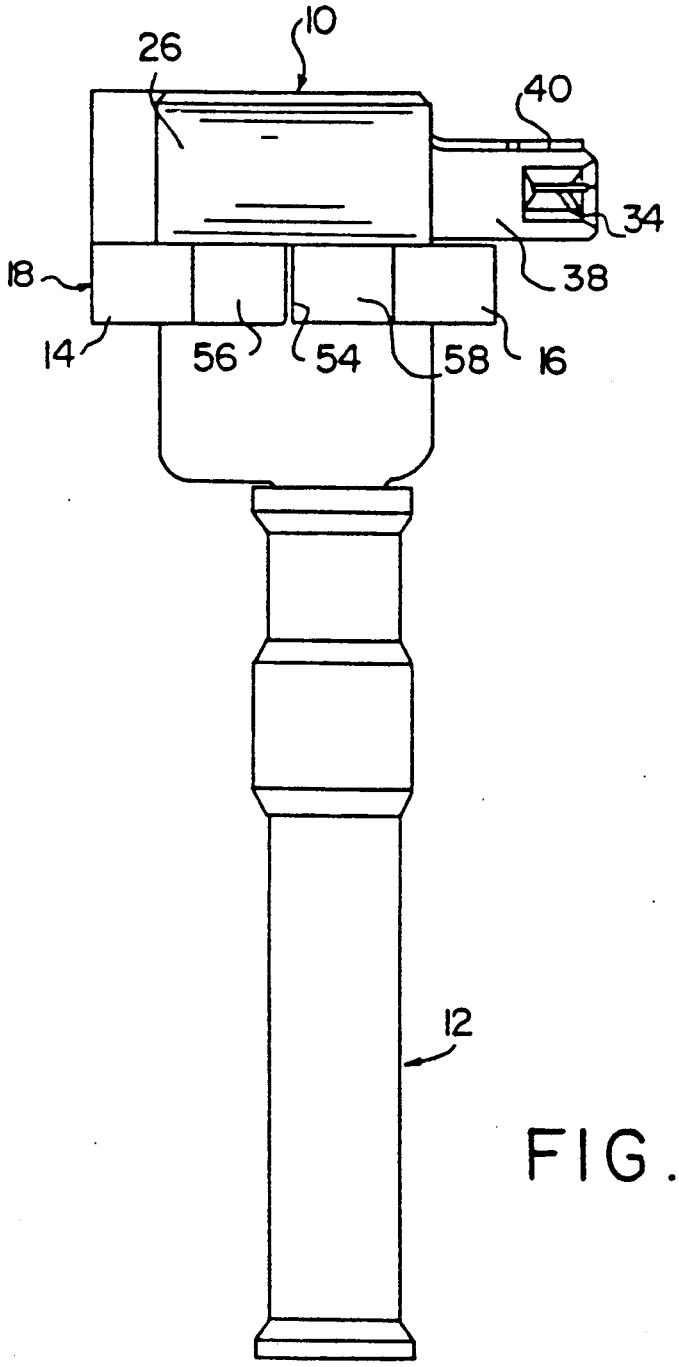
FIG. 2 is a side elevational view of the ignition unit of FIG. 1.

The ignition unit shown in FIG. 1 is illustrated in FIG. 2 in side view. In addition to the features already explained by reference to FIG. 1, the welded connection 54 of the two outer legs 56 and 58 of the two E-shaped halves 14 and 16 of the coil core 18 can be additionally seen in this FIG. 2. As a result of the welded connection of the outer legs 56 and 58 of the two E-shaped halves 14 and 16 of the coil core 18, an air gap and therewith an undesirable magnetic stray or leakage field can be avoided which contributes to a good efficiency of the ignition coil 10.

The construction of the coil core 18, whose non-visible parts are shown in dash line, can be seen from the top plan view of the ignition coil unit shown in FIG. 3. As can be readily seen from FIG. 3, the coil core 18 is composed of two E-shaped halves 14 and 16 whose center E-legs 20 and 22 form together the main core 24 which is concentrically surrounded by the primary and the secondary winding X of the ignition coil 10. A defined air gap 60 is provided between the two center E-legs 20 and 22, by means of which the inductivity of the ignition coil is decisively influenced. The outer legs 56 and 58, respectively, 62 and 64 of the E-shaped halves 14 and 16 of the coil core 18 are securely connected with each other by the welded connections 54, respectively, 66, as a result of which the advantages explained hereinabove are attained. The attachment areas 68, 70, 72 and 74 of the outer legs 56, 58, 62 and 64 of the two E-shaped halves 14 and 16 of the coil core 18 are constructed reinforced whereby bores 76, 78, 80 and 82 for accommodating fastening bolts (not shown in this figure) are provided in the reinforced areas thereof. In order not to damage the coil core 18 during the fastening of the ignition unit at a cylinder head of an internal combustion engine, washers 84, 86, 88 and 90 welded to the coil core 18 are provided at the bottom side of the coil core 18 at the bores 76, 78, 80 and 82 (see also FIG. 1).

FIG. 4 illustrates the interior construction of the spark plug connector 12. The connecting member 48 cast integrally with the lower end of the insulating body 26 of the ignition coil and introduced into the casing 46 of the spark plug connector 12, carries at its free end a contact element 92 electrically connected with the secondary winding of the ignition coil 10. This contact element 92 is connected with the electrically conducting part 94 of the spark plug connector 12 by a joint-like movable, electrically conducting connection in the form of a spring element 96. Owing to this joint-like movable connection, a deviation of the axial direction of the connecting member 48 of the ignition coil 10 from the axial direction of the spark plug 32 can be compensated. The electrically conducting part 94 of the spark plug connector 12 is connected with an electrically conducting coil spring 98, by means of which the contact of the electrically conducting part 94 of the spark plug connector 12 with the center electrode 100 of the spark plug 32 is established.

Figure 5:
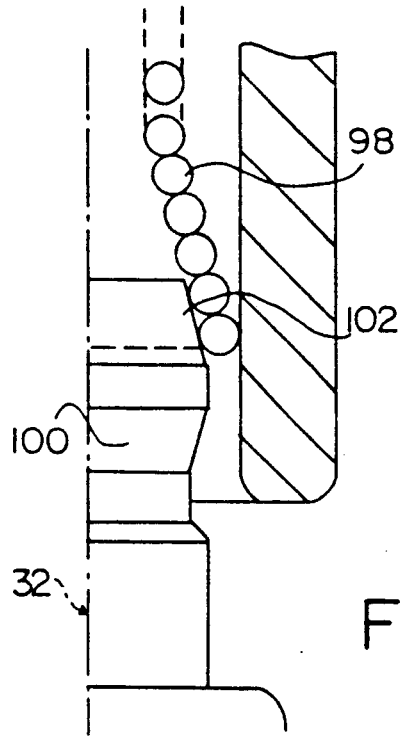
FIG. 5 is a cross-sectional view on an enlarged scale (five times) of the detail A in FIG. 1.

In FIG. 5, the section A of FIG. 4 showing the contact of the spark plug connector 12 with the center electrode 100 of the spark plug 32 is shown enlarged five times. It can be seen particularly clearly from this enlarged illustration, the diameter of the coil spring 98 continuously increases toward its free end. It forms in this manner an opening cone which abuts over large areas at the conical end 102 of the spark plug center electrode 100, as a result of which a particularly good electrical contact is assured.

Figure 6:
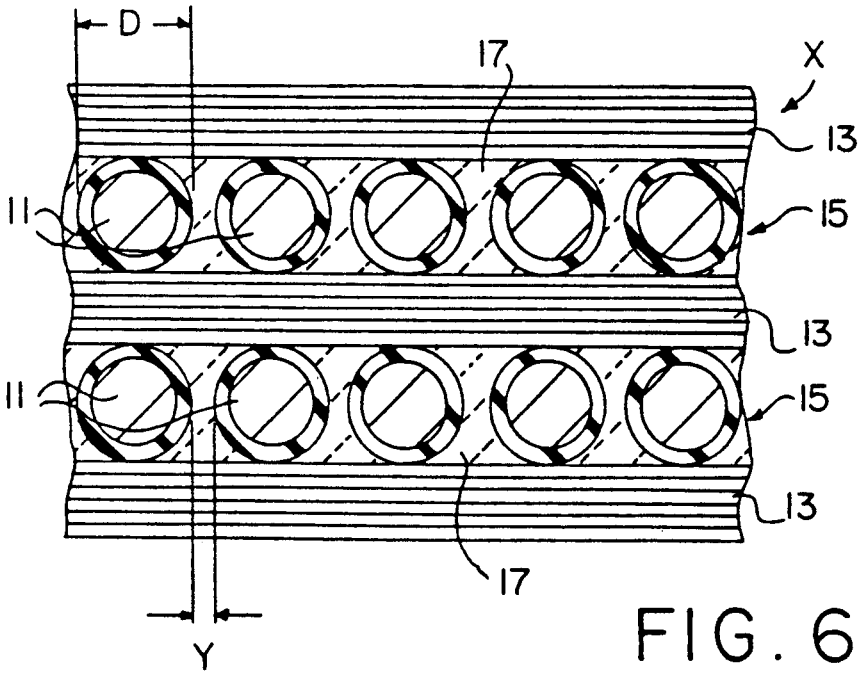
FIG. 6 is a cross-sectional view of one of the primary and secondary windings of the ignition coil.

FIG. 6 illustrates one of the primary and secondary windings X, wherein the winding wires 11 of at least one of the primary and secondary windings X are wound layerwise and one insulating paper layer 13 is provided between each individual winding layer 15. The winding wires 11 of each winding layer 15 are arranged with a space Y and interstices between the winding wires 11 are filled with a cast insulating mass 17 according to a further embodiment of the invention. This spacing Y of the winding wires 11 amounts, for example, to about 5% to about 10% of the respective winding wire diameter D.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An ignition unit coupling with a spark plug terminal in an internal combustion engine, comprising:

ignition coil means having a ferromagnetic core including a main core, said ignition coil means being integrated with and positioned above a spark plug connector means and the spark plug terminal when the ignition unit is installed in an internal combustion engine, a lower end of said spark plug connector means coupling with the spark plug terminal, primary and secondary windings being arranged about the main core surrounded by an insulating means, the ignition coil means, the spark plug connector means and the spark plug terminal being so arranged with respect to one another such that the axial direction extending through the spark plug connector means and the spark plug terminal intersects and forms an approximate right angle with the axial direction of the main core of the ignition coil.

2. An ignition unit according to claim 1, wherein the end areas of the main core are connected with each other by way of at least one core portion disposed outside of the primary and second winding.

3. An ignition unit according to claim 2, wherein the coil core is assembled of two substantially E-shaped halves, whose center E-legs form together the main core.

4. An ignition unit according to claim 3, wherein a defined air gap is provided between the two center E-legs forming the main core.

5. An ignition unit according to claim 3, wherein the outer legs of the two E-shaped halves are rigidly connected with each other.

6. An ignition unit according to claim 5, wherein the outer legs of the two E-shaped halves are welded together.

7. An ignition unit according to claim 3, wherein one bore each for receiving a fastening bolt is provided in attachment areas of the outer legs of the two E-shaped halves of the coil core.

8. An ignition unit according to claim 7, wherein the attachment areas of the outer legs of the two E-shaped halves of the coil core are constructed reinforced and wherein the bores are provided at least partially within the reinforced areas.

9. An ignition unit according to claim 1, wherein the winding wires of at least one of primary and secondary windings are wound layerwise and wherein one insulating Paper layer each is provided between the individual winding layers.

10. An ignition unit according to claim 9, wherein the winding wire sections of a winding layer are arranged each with a spacing and wherein the interstices between the winding wire sections are filled out with a cast insulating mass.

11. An ignition unit according to claim 10, wherein the spacing of the winding wire sections amounts to about 5% to about 10% of the respective winding wire diameter.

12. An ignition unit according to claim 1, wherein the insulating means surrounding the primary and secondary winding consists completely of a cast material and is cast in one piece without casing.

13. An ignition unit according to claim 1, wherein the insulating means, with the use of a coil core composed of two E-shaped halves, abuts far-reachingly at the inner circumference thereof.

14. An ignition unit according to claim 1, wherein the insulating means is constructed in the form of a handle.

15. An ignition unit according to claim 1, further comprising Primary connecting contact means connected with the primary winding which are led out of the insulating means in the axial direction of the primary coil.

16. An ignition unit according to claim 15, wherein the primary connecting contact means are arranged in a plug-shaped extension of the insulating means.

17. An ignition unit according to claim 16, wherein detent means are provided at the plug-shaped extension for a locking engagement of a plug extending over the plug-shaped extension.

18. An ignition unit according to claim 1, wherein a contact element electrically connected with the secondary winding is provided at the end of the insulating body means facing the spark plug connector means.

19. An ignition unit according to claim 18, wherein a joint-like movable electrically conducting connection is provided between said contact element and the electrically conducting part of the spark plug connector means.

20. An ignition unit according to claim 19, wherein the joint-like movable electrically conducting connection is constituted by a spring element.

21. An ignition unit according to claim 1, wherein a coil spring conically enlarged in the direction toward its free end is provided as contact means of the spark plug connector means acting on the center electrode of a spark plug.

22. An ignition unit according to claim 21, wherein a casing is provided as part of the spark plug connector means which protrudes between the contact means of the spark plug connector means and forms a socket completely covering the spark plug neck and circumferentially securely abutting at the threaded head of the spark plug.

23. An ignition unit according to claim 22, wherein within the area of its free end the inner diameter of the socket increases toward the outside.

24. An ignition unit according to claim 22, wherein the casing consists of elastic silicon rubber.

25. An ignition unit according to claim 9, wherein the coil core is assembled of two substantially E-shaped halves, whose center E-legs form together the main core.

26. An ignition unit according to claim 25, wherein the insulating means surrounding the primary and secondary winding consists completely of a cast material and is cast in one piece without casing.

27. An ignition unit according to claim 3, wherein the insulating means, with the use of a coil core composed of two E-shaped halves, abuts far-reachingly at the inner circumference thereof.

28. An ignition unit according to claim 15, wherein a contact element electrically connected with the secondary winding is provided at the end of the insulating body means facing the spark plug connector means.

29. An ignition unit according to claim 28, wherein a coil spring conically enlarged in the direction toward its free end is provided as contact means of the spark plug connector means acting oh the center electrode of a spark plug.

30. An ignition unit according to claim 29, wherein a casing is provided as part of the spark plug connector means which protrudes between the contact means of the spark plug connector means and forms a socket completely covering the spark plug neck and circumferentially securely abutting at the threaded head of the spark plug.

31. An ignition unit according to claim 30, wherein within the area of its free end the inner diameter of the socket increases toward the outside.

32. An ignition unit according to claim 31, wherein the casing consists of elastic silicon rubber.

* * * * *